US008171846B2

(12) United States Patent
Taylor

(10) Patent No.: US 8,171,846 B2
(45) Date of Patent: May 8, 2012

(54) METHOD AND APPARATUS FOR FORMING SELF-SUPPORTING BALES OF METAL CANS

(76) Inventor: William S. Taylor, Lancaster, KY (US)

( * ) Notice: Subject to any disclaimer, the term of this patent is extended or adjusted under 35 U.S.C. 154(b) by 341 days.

(21) Appl. No.: 12/410,709

(22) Filed: Mar. 25, 2009

(65) Prior Publication Data

US 2010/0242746 A1 Sep. 30, 2010

(51) Int. Cl.
*B30B 9/32* (2006.01)
*B30B 13/00* (2006.01)
*B30B 15/00* (2006.01)

(52) U.S. Cl. ..... 100/35; 100/245; 100/295; 100/902

(58) Field of Classification Search ..... 100/35, 100/41, 178, 179, 240, 241, 245, 295, 902, 100/906
See application file for complete search history.

(56) References Cited

U.S. PATENT DOCUMENTS 2,711,343 A 6/1955 Falk et al.
3,783,494 A * 1/1974 Whalen et al. ..... 29/403.2
4,140,339 A 2/1979 Fredin
4,268,084 A 5/1981 Peters
4,287,823 A * 9/1981 Thompson ..... 100/129
4,489,975 A 12/1984 Fredin
4,601,238 A * 7/1986 Davis et al. ..... 100/45
4,690,609 A 9/1987 Brown
4,809,600 A * 3/1989 Yamamoto et al. ..... 100/193
5,488,911 A 2/1996 Riggin
5,667,268 A 9/1997 Bump
6,309,164 B1 10/2001 Holder et al.
6,546,855 B1 * 4/2003 Van Der Beek et al. ..... 100/39
6,695,390 B2 2/2004 Bucco Morello
6,896,316 B1 5/2005 Taylor
6,902,226 B1 6/2005 Taylor

* cited by examiner

*Primary Examiner* — Jimmy T Nguyen
(74) *Attorney, Agent, or Firm* — Pitts & Lake, P.C.

(57) ABSTRACT

Apparatus for forming a self-supporting ale of metal cans comprising a baler adapted to compact metal cans into a bale. Opposite side walls of the baler include an array along each side wall of parallel open-face grooves. A platen having defined along each of its opposite sides walls, an array of projections adapted to be received within respective ones of the wall grooves in meshing relationship whereby movement of the platen along the length of the baler functions to compact the cans disposed within the grooves to a higher degree of densification than the degree of densification of cans proximate the central portions of the bale.

6 Claims, 6 Drawing Sheets

METHOD AND APPARATUS FOR FORMING SELF-SUPPORTING BALES OF METAL CANS

CROSS-REFERENCE TO RELATED APPLICATIONS

Not Applicable

STATEMENT REGARDING FEDERALLY SPONSORED RESEARCH OR DEVELOPMENT

Not Applicable

FIELD OF INVENTION

This invention relates to recycling of metal cans, particularly used aluminum cans (UBC). Quantities of cans are collected and formed into bales suitable for transport from a baling area to a smelting facility, including handling and storage of the bales in between their formation and their processing at a smelter.

BACKGROUND OF INVENTION

Recycling of aluminum cans (sometimes referred to as UBC (Used Beverage Cans) is reported to be a most important aspect of the consumer waste stream. It is common to collect empty, commonly "used", metal cans for recycling of the metal of the cans by converting the cans to their metallic identify. Whereas many locations may be employed to collect a relatively small volume of cans at each of such locations, at some phase of the recycling program, for economic and other reasons, these small quantities of cans are brought together, crushed and pressed together in a baler. Within this baler a relatively large quantity of cans are crushed (e.g. compacted) into individual bales (commonly rectangular in geometry) of crushed cans. Heretofore such bales were bound about their girth by one or more wire binders designed to preclude collapse of the bales. These bales are shipped by truck, railcar or sea container to smelting facilities. After analysis of the cans, the wire binders are removed from the bale and the bales are fed into a shredder where they are broken up into small pieces and processed through a smelter furnace.

Compression of the cans into a bale, commonly of a rectangular geometry provides a cost effective and otherwise efficient mode of transferring a collection of cans to a smelting facility. A major problem encountered in baling of metal cans relates to the binding of the bales as they are formed so that the bales retain their integrity when the bales are expelled from the baler, transported direct to a smelting facility or placed in temporary storage. During such time period the bales are subjected to lifting and transfer using lift forks or like equipment. As noted, heretofore, it has been common to wrap each bale at spaced apart locations along the length of each bale, with metal wire binders (bailing wire) which serve to keep the bale from coming apart during handling, transit or other activities. Such wire remains on the bales until the bales are ready to be introduced into a shredder at a processing center, e.g. a smelter). First, wire when wrapped about the firth of a bale of cans only apply containment pressure against those crushed cans of the bale which are proximate the wires, leaving the portion of the bale outside the holding influence of the wires free to expand and potentially cause collapse of the bale. Second, these wires tend to break or their ends separate, leaving the bales free of the restraint afforded by the wires such that the bales involuntarily dissipate. Third, the loose wires can become entangled with any of many objects, such as the framework of warehouse shelving, or within the processing equipment. In any such event, the cost of processing of the cans is increased due to the loss of time for completion of the overall processing of the cans. Especially of importance of downtime of the processing equipment during which loose wires are untangled from the processing equipment. Fourth, even if the wire binders remain intact, they must be removed before the bale can be introduced into the smelter. Collection and disposal of these wire binders is a further disadvantage with respect to cost of the recycling operation and even safety of workers which remove the wire binders.

BRIEF SUMMARY OF INVENTION

The present inventors have discovered that self-supporting "wireless" bales of crushed metal cans can be obtained through the mechanism of introducing enhanced multiple spaced apart densification forces against the opposite sides of a "being formed" bale of crushed cans. In a preferred embodiment, simultaneously with the application of densifications forces against the sides of a being-formed bale, densification of the central inner portions of the resulting bale is effected by the application of a selected pattern of pressure against the central portion of at least one end of the bale as it is being formed. Such controlled densification of selected regions of the bale, have been found to eliminate the need for wire binders.

DETAILED DESCRIPTION OF THE FIGURES

DETAILED DESCRIPTION OF THE INVENTION

Figure 1:
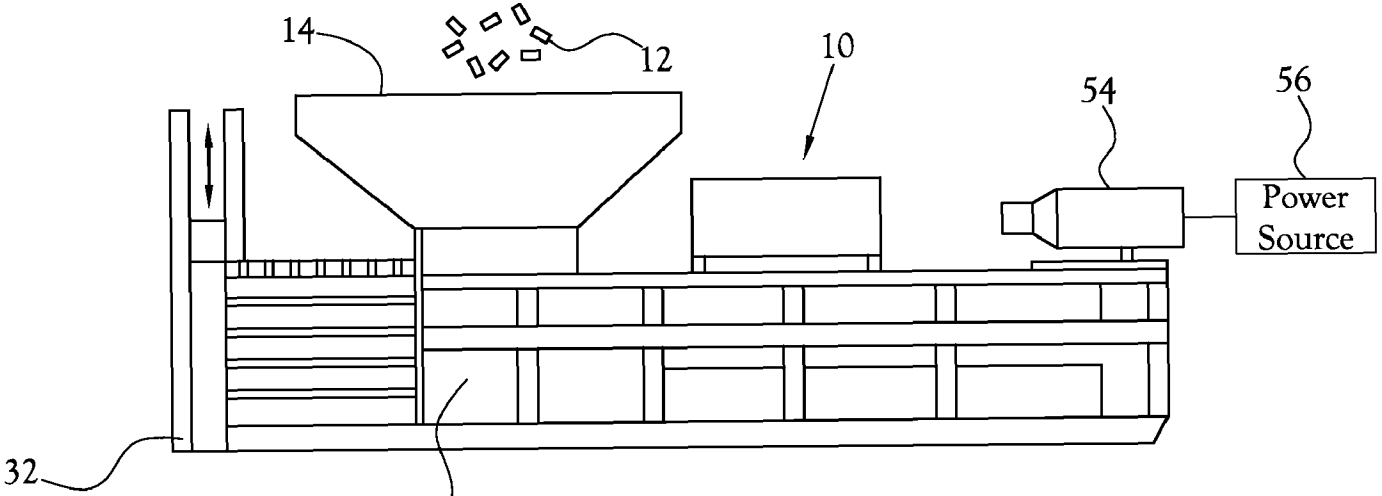
FIG. 1 is a representation of one embodiment of a can baler embodying various features of the present invention.
Figure 2:
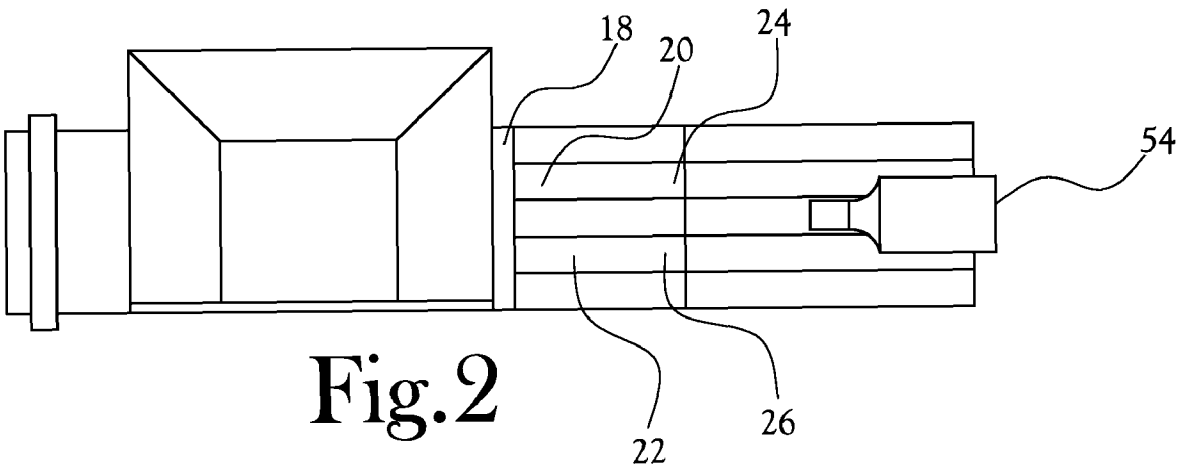
FIG. 2 is a top view of the can baler of FIG. 2.

With initial reference to FIG. 1, a typical baler 10 for UBCs 12 includes a collection hopper 14 through which UBCs are introduced to an elongated compaction chamber 16 of the baler. From this hopper, the cans fall by gravity into the generally rectangular hollow geometry of the compaction chamber. At a selected time, these cans are contacted with a generally planar platen 18 which is mounted for linear reciprocatory movement along the length of the compaction chamber In the depicted embodiment, this platen is mounted on the inboard ends 20,22 of two hydraulically driven rams 24.26 (e.g., piston-cylinder devices, for example), which serve to move the platen along the length of the compaction chamber to form a bale 28 of crushed and compacted UBCs and then be retracted to its rest position 30 wherein the platen defines a movable rear end wall 32 of the compaction chamber as depicted in FIGS. 3A and 4.

In accordance with the present invention, a self-supporting formed bale 28, free of extraneous binders such as baling wires or the like is pushed by the plannent out of the forward end 38 of the compaction chamber through a rear door 40 of the compaction chamber.

Referring to FIGS. 1-4, the platen of the present invention is of a generally planer plate geometry defining a forward rectangular face 40 having a top edge 46, a bottom edge 48, and first and second opposite side edges 50 and 52, respectively. The top and bottom edges may be straight and smooth and serve to guide the reciprocatory movement of the platen along the length of the compaction chamber. This platen is mounted in an upright attitude, i.e., perpendicular to the length of the baler, on the forward ends of the pair of hydraulic rams, each of which may be of a seven inch bore piston-cylinder reciprocating design. Power for driving these piston/cylinder elements may be supplied by a conventional electric motor 54 electrically connected to a source of electrical power 56 which is controlled by a conventional controller (not shown).

Figures 3A, 3B:
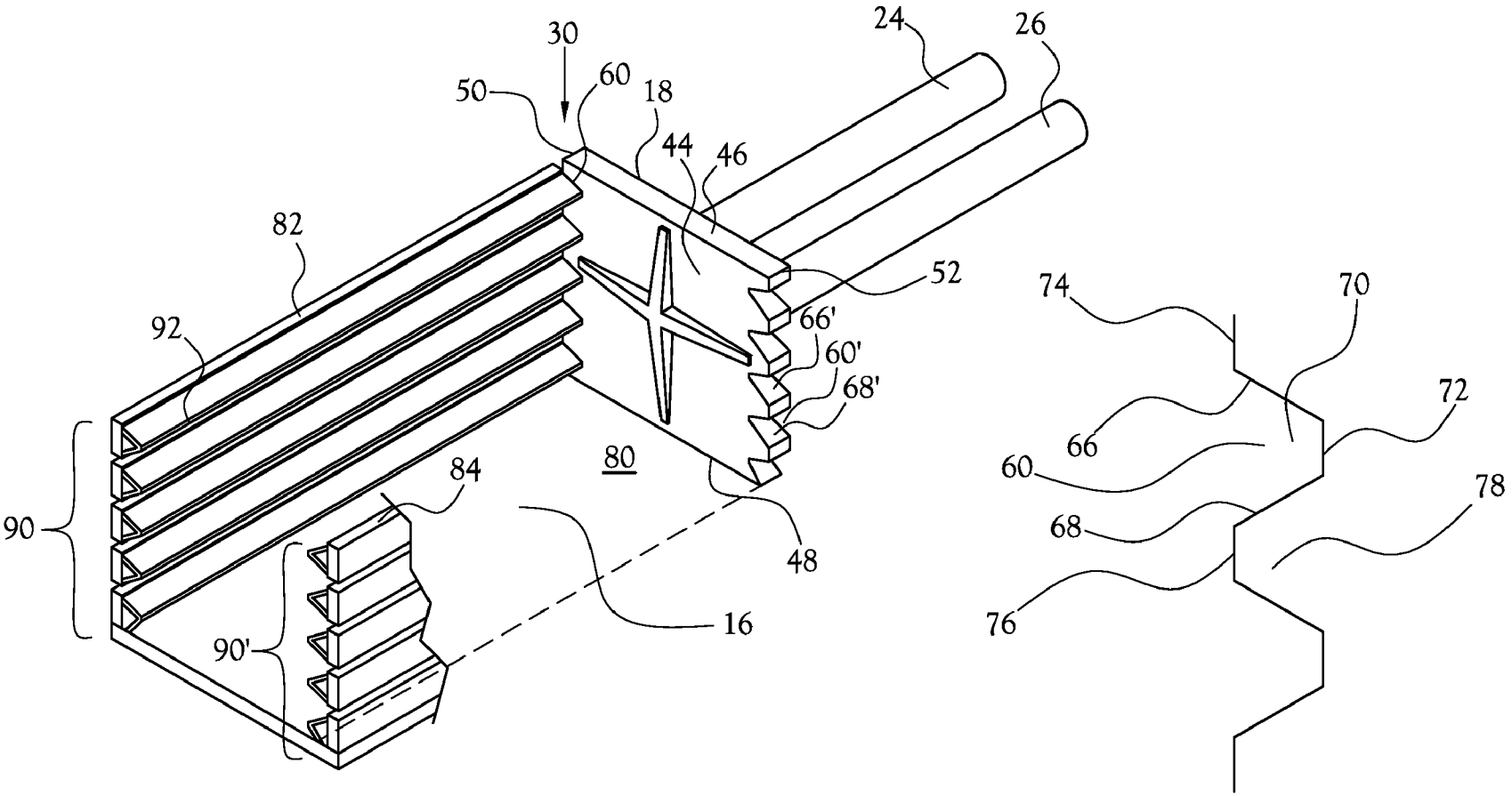
FIG. 3A is a fragmentary representation of a compaction chamber and a platen slidably disposed therein.
FIG. 3B is a fragmentary representation of a portion of a top corner of the compaction and platen depicted in FIG. 3A.
Figure 4:
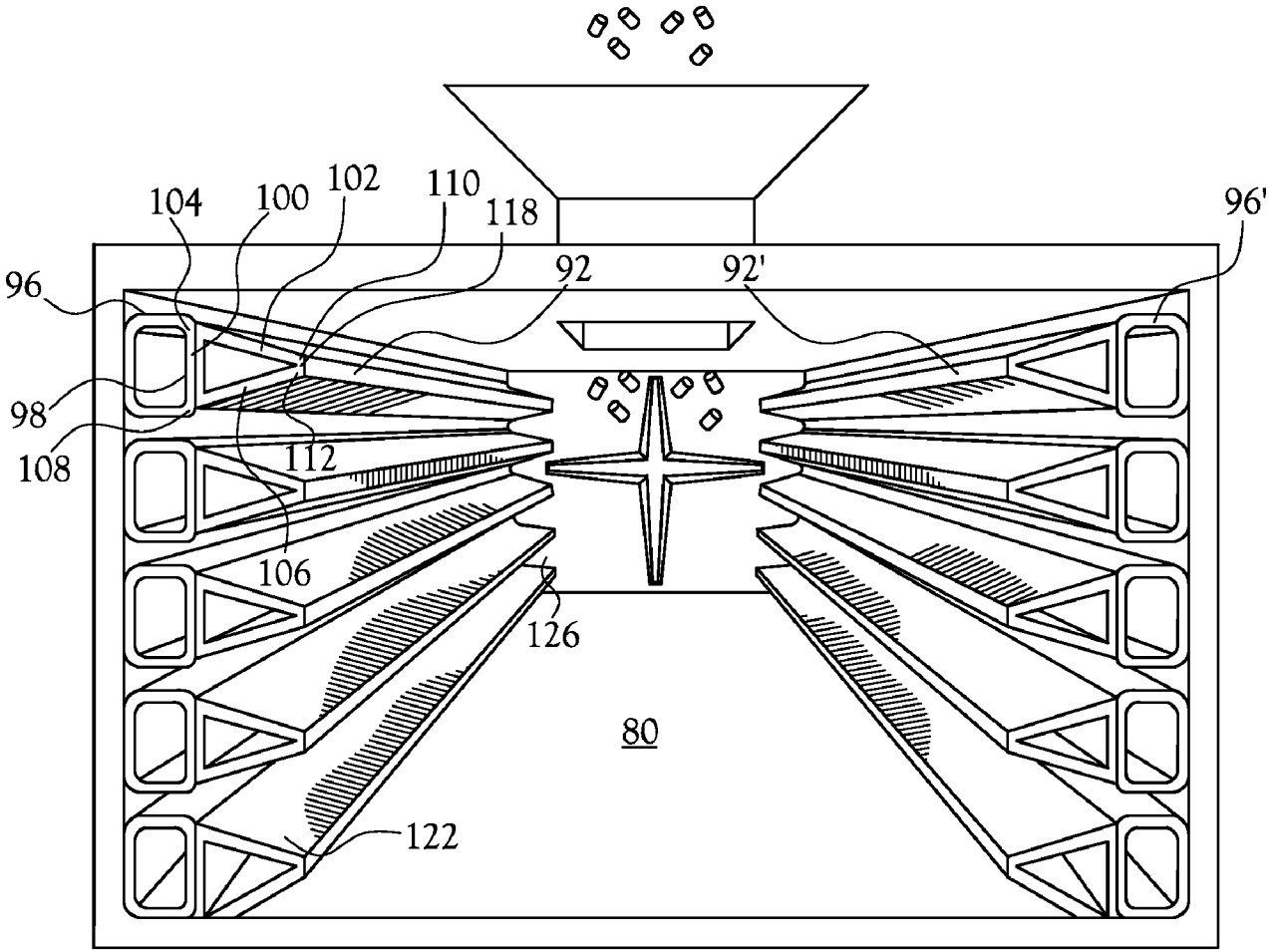
FIG. 4 is a representation of the interior of the left hand end of the baler depicted in FIG. 1 as taken through an open left hand end of the baler and depicting the interior of a compaction chamber of one embodiment of the baler depicted in FIG. 1.

As depicted in FIGS. 3A and 4, in accordance with one aspect of the present invention, each of the first and second side edges of the platen is provided with an array of elongated adjacent parallel, substantially horizontally oriented open-face grooves 60 which project laterally inwardly of their respective side edge of the platen. Each such groove of this array is of a substantially triangular cross section.

Each of the legs 66,68 (typical) of the triangular cross section of each of the grooves 60 extends laterally outwardly of the inwardly disposed apex 72 of the triangle and within the plane of the platen with the apical angle between the legs being about 30 degrees. This construction of the grooves provides a depth (triangular height) of about 3 inches for each groove. The separation distance between adjacent parallel grooves on each of the side edges of the platen Is chosen In the depicted embodiment to provide a lateral spacing between apices of adjacent grooves of about 2½ inches. As seen in FIG. 3, the inboard ends 74 and 76, (typical of the) legs of adjacent grooves on a first side edge of the platen are joined to one another with such bonded leg ends collectively defining such first side edge 5 of the platen. Further, the legs of adjacent grooves cooperatively define an array of elongated parallel projections 78 (typical) along the first side edge of the platen.

As depicted in FIG. 3 the second side edge 52 of the platen is a mirror image of the first side edge 50 of the platen, including an array of elongated adjacent grooves 60'. Like elements of the second side edge of the platen to the elements of the first side edge of the platen are identified with primed numerals in the accompanying drawings.

Referring to FIGS. 1 and 3, the baler of the present invention includes an elongated compaction chamber including a hopper 14 through which individual or relatively small groupings of UBCs 12 are fed into the compaction chamber. The depicted compaction chamber includes a bottom floor 80 onto which cans fall by gravity when dumped into the hopper. The horizontal level of this bottom floor is chosen such that the bottom edge of the platen will smoothly slide along such floor as the platen is moved along its reciprocating path through the compaction chamber.

As seen in FIGS. 3A and 4, this floor extends to the forward end 38 of the compaction chamber and in combination with the first and second side walls defines the compaction chamber that extends from the at rest location of the platen, along the compaction chamber to terminate at the rear door 40 at the forward end 38 of the baler, for expelling a finished bale from the baler. By this means, the platen may be moved from its at rest position as seen in FIGS. 3 and 4 to the exit end of the channel to crush, compact and sweep UBCs along the compaction chamber thereby compacting the UBCs into a self-supporting bale free of extraneous binders in accordance with the present invention ready to be expelled from the baler through the rear door 40.

Figure 5:
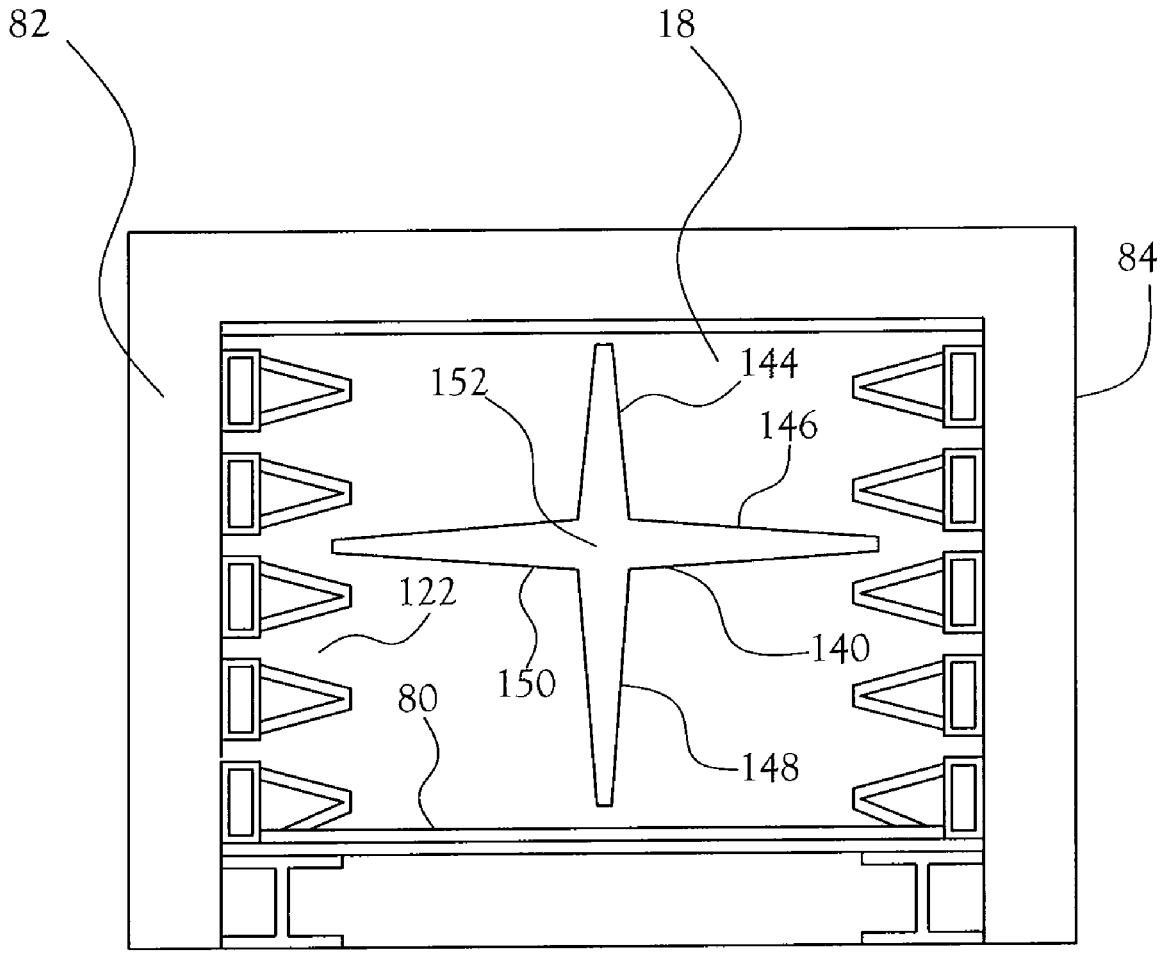
FIG. 5 is a representation of a cross section of the compaction chamber depicted in FIG. 4.
Figure 6A:
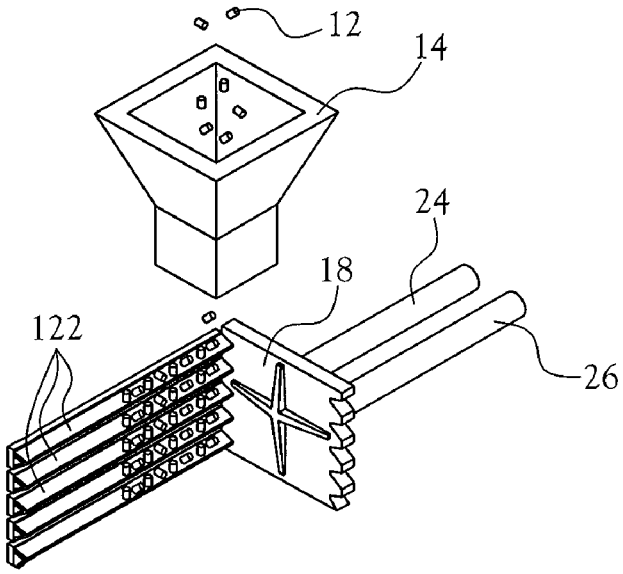
FIG. 6A is a representation of the initial compaction of UBCs in the grooves of a side wall of the present invention.
Figure 6B:
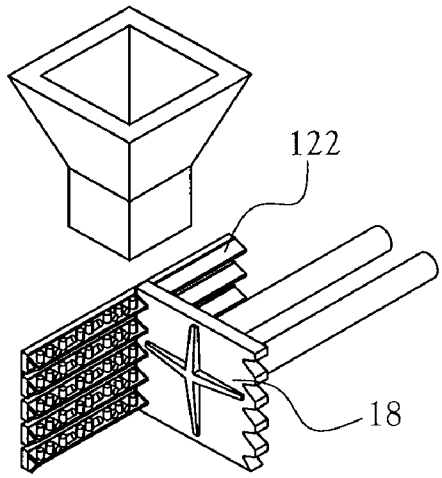
FIG. 6B is a representation of the progression of compaction of UBCs in the grooves of a side wall of the present invention as the platen moves toward the exit end of the compaction chamber.
Figure 6C:
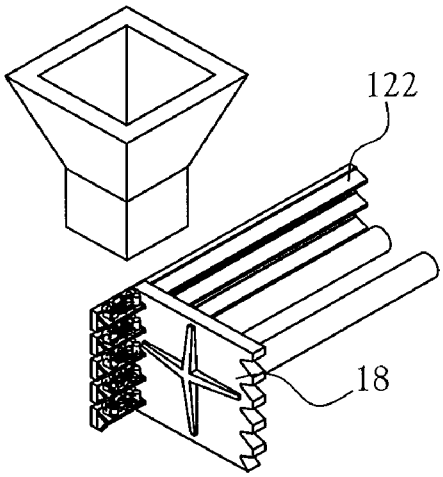
FIG. 6C is a representation of the near completion of the compaction of the quantity of UBCs into a bale proximate the exit end of the compaction chamber.
Figure 7:
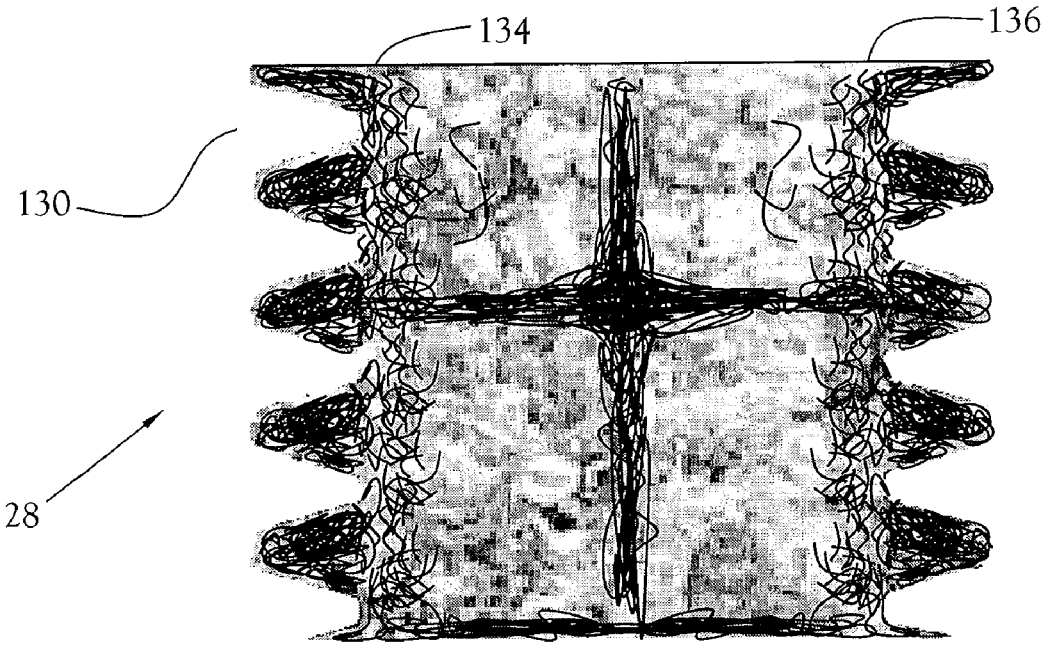
FIG. 7 is a schematic representation of an end of a bale of UBCs formed employing the present invention.
Figure 8:
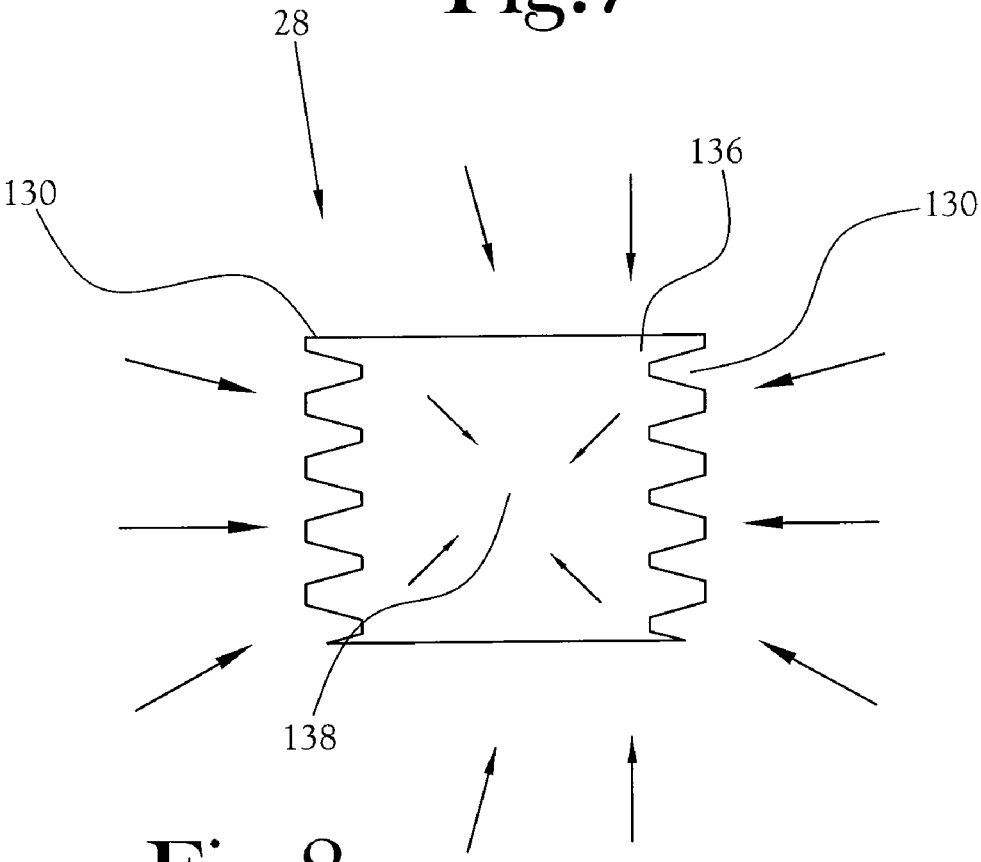
FIG. 8 is a schematic representation of the compaction forces applied to a quantity of UBCs employing the present invention to combine such UBCs into a self-supporting bale and depicting the different values of such pressure forces within a cross-section of the bale being formed.

As depicted in FIGS. 4 and 5, the first and second side walls 82 and 84, respectively, of the compaction chamber are each provided with respective arrays 90 and 90' of elongated parallel projections 92, 92' (typical) which individually extend from their respective side wall outwardly from such wall and partially into the reciprocatory path of the platen as it moves along the length of the compaction chamber.

As seen in FIG. 5, the first side wall of the compaction is provided with a plurality of tubular metal beams 96 of rectangular cross section mounted horizontally and in adjacent relationship on the inboard surface of the first side wall.

Referring to FIGS. 1-4, the inboard side 98 of each beam includes a planar face 100 which is directed inwardly of the compaction chamber. On this planar face of each beam, the present inventor provides a respective projection 92 having a substantially triangular cross-section. This planar face of each beam defines the base for each of the triangular projections.

A first leg 102 of the triangular geometry of each projection extends from one corner edge 104 of the base beam angularly at an angle of about 23 degrees inwardly of the compaction chambers and the second leg 106 of the triangle extends from an opposite corner edge 108 of the base beam at a selected angle so that the distal ends 110,112 of the legs meet and define the apex 118 of the triangular projection of about 34 inches height as measured along the height of the triangle. In this example, each base beam may comprise a steel tube of rectangular cross section and being 3 inches wide and 5 inches deep. Further in this example, each leg of each projection may be 10 feet in length. Like the base, each leg of each elongated projection may be in the form of a steel plate of ½ inch thickness.

The individual ones of these elongated parallel projections are spaced apart from one another by a relatively small gap, of a few inches, for example, thereby defining an elongated groove of triangular cross section defined between adjacent ones of the elongated projections 92, and which extends along the length of a respective one of the opposite side walls 82, 84 of the compaction chamber. Notably, in the depicted embodiment, there are provided five vertically spaced apart individual projections along each of the first and second side walls of the compaction chamber. Further, it is to be noted that these projections define six grooves defined along each of the side walls of the compaction chamber.

As noted hereinabove, the platen of the depicted embodiment is provided with seven parallel grooves per each side edge of the platen (five grooves defined solely by adjacent projections and two top and bottom grooves defined between respective ones of top and bottom projections and the top wall and floor of the compaction chamber as seen in FIGS. 3 and 5. Thus, when the platen is moved into the compaction chamber, the projections 78 between the grooves 60 of each side of the platen are slidably and meshingly received within respective ones of the grooves 122 defined along the side walls of the compaction chamber. Inasmuch as the projections on the first and second side edges of the platen are designed to fit substantially fully within respective mating grooves defined along the length of the side walls of the compaction chamber, as the platen is moved forward toward and through the compaction chamber, the UBCs disposed in the arrays of grooves along the side walls of the compaction chamber are crushed and compacted more completely and in tighter packed relationship with one another by reason of the meshing projections and grooves along the side walls.

Referring to FIGS. 3, 4, 6A-6C, 8 and 9, it has been found by the present inventor that, the projections 78 of the platen which mesh with the grooves 122 of the side walls of the compaction chamber, act to close one end of each groove 122, initially at the terminal end of the groove proximate the at east position of the platen, such that each such groove effectively is converted into a reduced volume open-face compaction subchamber of extended length. Within the compaction chamber, UCBs collect in these subchambers. As the platen progresses along the compaction chamber, each of these subchambers gradually becomes smaller in size due to their shortened length. The present inventor has further discovered that UBCs disposed within such subchambers compact to a substantially greater degree of densification as compared to the degree of densification of those UBCs which are more central of the forming bale. In fact, it has been found that the densification of the UBCs within the individual grooves 122 in the side walls of the compaction camber compacts the cans to the extent that permanent grooves 130 (typical) are formed in the opposite side walls 134, 136 of a formed bale and that such grooves impart rigidity to, and preclude premature collapse of, the bale after it exits the baler free of extraneous binders, such as baling wire and the like.

In one embodiment of the present invention, the inventor has found that enhanced densification of the central portion 138 of a bale of metal cans may be effected by means of a compacting element 140 mounted or defined on the face 44 of the platen. In the depicted embodiment seen in FIG. 4, this element may take the form of a cross having four legs 144-150 emanating from a central crossing junction 152 of these legs and which extends outwardly from the face of the platen by a first distance which is materially greater than the height of the outboard ends of each of the flared legs of the element. In the depicted embodiment, the height of each leg of the cross is reduced substantially uniformly from the junction to the ends of the legs. By way of example, a first junction height may be about seven inches which height gradually reduces between the junction and the outboard end of each leg to a minimum height of about one inch. In this embodiment, each leg extends about 12 inches from the junction (a total spread of about 24 inches). In this embodiment, as the platen is moved toward the exit door of the baler, this compacting element contributes to the densification of the central portion of the formed bale.

As will be recognized, this enhanced crushing and compaction of the cans along the side walls of the compaction chamber has been found to enhance the densification of the cans adjacent the side walls to the extent that the ultimately formed bale of cans is self-supporting, i.e., the bale remains intact without the use of baling wire or like bale binders. Importantly, the present inventor has found that such bales not only withstand lifting, stacking, hauling and like activities, the bale is readily collapsed at the smelting facility and that the cans are of acceptable mill quality when received at the smelting facility, meaning that the bales are readily broken down and shredded employing pre-existing processing equipment at the smelting facility.

In accordance with one aspect of the present invention, there is provide a method for baling metal cans without the use of anti-bale-collapse binders comprising the steps of A. defining an array of elongated parallel outwardly opening grooves along each of the side walls of a compaction chamber defined within a can baler, B. substantially closing one end of each of said grooves with respective ones of an array of projections extending from each of the first and second opposite side edges of a platen, thereby defining an open-face compaction subchambers within each of such grooves, and.

C. moving the platen along length of the compaction chamber whereby the moving projections of the platen compact cans disposed within respective ones of the subchambers into self-supporting grooves defined in a compacted bale of the cans.

In one embodiment of such method for baling metal cans into self-supporting bales without use of bale binders employing a baler having a compaction chamber defined therein, the compaction channel includes first and second opposing side walls, a platen reciprocatably moveable within the compaction chamber for compaction of cans disposed with said channel.

Along each of the side walls of the compaction chamber, there is provided an array of elongated parallel grooves, each being of a generally triangular cross-section geometry, the apex of the triangular cross section of each such groove being adjacent a respective side wall of the channel and the legs of the triangular cross section projecting into the channel with legs of laterally adjacent grooves being joined to one another. The grooves of the first side wall of compaction chamber are horizontally aligned with respective ones of said grooves on the second side wall of the compaction chamber. On each of the side edges of the platen there is defined an array of projections which extend laterally outwardly from their respective side edge, the projections on one side edge of the platen being horizontally aligned with and slidably received within, respective ones of the array of projections on the opposite second side edge of the platen. Those ones of the projections on the first side edge of the platen being disposed in meshing sliding relationship to respective ones of the grooves along the first side wall of the channel and respective ones of the array of projections on the opposite second side edge of the platen being disposed in meshing sliding relationship to respective ones of the grooves along said second side wall of the channel whereby the projections of the platen define respective moving closures of their respective grooves, thereby defining a plurality of open-face elongated subchambers 124 of reducing volume as the platen progresses from its at rest position along the channel through the compaction chamber and into the baling chamber thereby crushing and compacting cans which may enter or be forced into, the grooves along the walls of the compaction chamber with increasing compaction forces being applied to those cans within each subchamber 124 and resultant development of a greater degree of densification of such cans than the degree of densification of the cans that are disposed more centrally of a forming bale of the cans as the platen moves toward and into the baler chamber. In this method, the bales formed are of a nature as preludes the collapse of the formed bale of cans without the use of extraneous binders. (See FIGS. 6A-6C, 8 and 9).

What is claimed is:

1. Apparatus for forming a self-supporting bale of metal cans comprising a baler including a compaction chamber having first and second opposite side walls defined along the length of said compaction chamber, an array of parallel open-face grooves defined in said first side wall of said compaction chamber and an array of parallel open-face grooves defined in said opposite second wall of said compaction chamber, said grooves of said first and second side walls being aligned horizontally, a platen having first and second side edges and being mounted for reciprocatory movement within said compaction chamber, an array of projections defined along each of said first and second side edges of said platen, said projections extending outwardly from said side edges with respective ones of said projections being received in meshing relationship with respective ones of said grooves defined in said side walls of said compaction chamber, each of said projections effectively closing its respective groove to define a compacting subchamber, drive means adapted to move said platen reciprocatably along the length of said compaction chamber whereby cans disposed within said compaction chamber are compacted into a bale, said cans disposed within said subchambers being compacted to a higher degree of densification than the degree of densification of central portions of said bale.

2. The apparatus of claim 1 wherein said compaction of said cans within said subchambers defines densified grooves in opposite sides of said bale.

3. The apparatus of claim 1 wherein said platen includes a forward face and including a structural projection defined on and generally centrally of said forward face whereby cans disposed generally centrally at adjacent end of said compaction chamber are contacted by said projections of said platen and densified to a greater degree of densification than said degree of densification of central portions of said bale.

4. A method for baling metal cans without the use of anti-bale-collapse binders comprising the steps of defining an array of elongated parallel outwardly opening grooves along each of the side walls of a compaction chamber defined within a metal can baler, substantially closing one end of each of said grooves with respective ones of an array of projections extending from each of the first and second opposite side edges of a platen, thereby defining a plurality of open-face compaction subchambers within said grooves, moving said platen along said compaction chamber whereby said moving projections of said platen compact cans disposed within respective ones of said subchambers into self-supporting grooves defined in a bale of said cans.

5. A method for baling metal cans into self-supporting bales without use of bale binders employing a baler having an elongated compaction chamber defined therein, said compaction chamber including first and second opposing side walls, a platen reciprocatably moveable within the compaction chamber for compaction of cans disposed with said compaction chamber comprising the steps of along each of the side walls of the elongated compaction chamber, providing an array of elongated parallel grooves, each being of a generally triangular cross-section geometry, the apex of the triangular cross section of each such groove being adjacent a respective side wall of the compaction chamber and the legs of the triangular cross section projecting into the compaction chamber with legs of laterally adjacent grooves being joined to one another, said grooves of said first side wall of said compaction chamber being horizontally aligned with respective ones of said grooves on said second side wall of said compaction chamber, including defining on each of the side edges of the platen an array of projections which extend laterally outwardly from their respective side edge, the projections on one side edge of the platen being horizontally aligned with and slidably received within, respective ones of the array of projections on the opposite second side edge of the platen, said ones of the array of projections on said first side edge of the platen being disposed in meshing sliding relationship to respective ones of said grooves along said first side wall of the compaction chamber and respective ones of the array of projections on the opposite second side edge of the platen being disposed in meshing sliding relationship to respective ones of said grooves along said second side wall of the compaction chamber whereby the projections of said platen define respective moving closures of their respective grooves, thereby defining a plurality of open-face elongated subchambers of reducing volume as the platen progresses from its at rest position along the compaction chamber, thereby crushing and compacting cans which may enter or be forced into, the grooves along the walls of the compacting chamber with increasing compaction forces being applied to those cans within each subchamber and development of a greater degree of densification of such cans than the degree of densification of the cans that are disposed more centrally of a forming bale of the cans as the platen moves along the compaction chamber.

6. The method of claim 5 wherein said densification forces applied to said cans within said subchambers define grooves along each of the opposite sides of a bale of cans, said bale being free of binders and which are of a nature as preludes the collapse of the formed bale of cans.

* * * * *